United States Patent [19]

Rinio

[11] 4,032,110

[45] June 28, 1977

[54] CABLE HAULING DEVICE COMPRISING SELF CLAMPING JAWS

[76] Inventor: Johannes Augustus Rinio, 5, Promenade Venezia, Grand Siecle, Versailles, France, 7800

[22] Filed: July 24, 1975

[21] Appl. No.: 598,810

[30] Foreign Application Priority Data

July 25, 1974 France ..... 74.25837

[52] U.S. Cl. ..... 254/76; 254/135 R
[51] Int. Cl.² ..... B66D 1/00
[58] Field of Search ..... 254/68, 76, 135 R

[56] References Cited

UNITED STATES PATENTS

| | | | |
|---|---|---|---|
| 1,920,686 | 8/1933 | Faure | 254/135 R X |
| 2,585,101 | 2/1952 | Faure | 254/135 R X |
| 3,799,503 | 3/1974 | Desplats | 254/135 R X |
| 3,863,893 | 2/1975 | Cavalieri | 254/135R X |

FOREIGN PATENTS OR APPLICATIONS

| | | | |
|---|---|---|---|
| 1,174,533 | 11/1958 | France | 254/135 R |

*Primary Examiner*—L. J. Paperner
*Assistant Examiner*—Donald W. Underwood
*Attorney, Agent, or Firm*—John J. Dennemeyer

[57] ABSTRACT

A cable hauling apparatus comprising two self clamping jaws displaced in opposite directions by an actuating lever and by a system of connecting rods so that one of the clamping jaws alternately clamps the cable and displaces it while the other clamping jaw slides freely along the cable. The actuating lever pivots on bearing pins in bearings located in a one piece block head separated from the housing containing the cable clamping mechanism and is shaped to permit machining of the bearing seats provided on the pivot pins of the actuating lever in a single operation, and the connecting rods are directly articulated to the lower end of the actuating lever excentrically with respect to the axis of rotation of the actuating lever and outside the pins located on this pivot.

7 Claims, 3 Drawing Figures

CABLE HAULING DEVICE COMPRISING SELF CLAMPING JAWS

Figure 1:
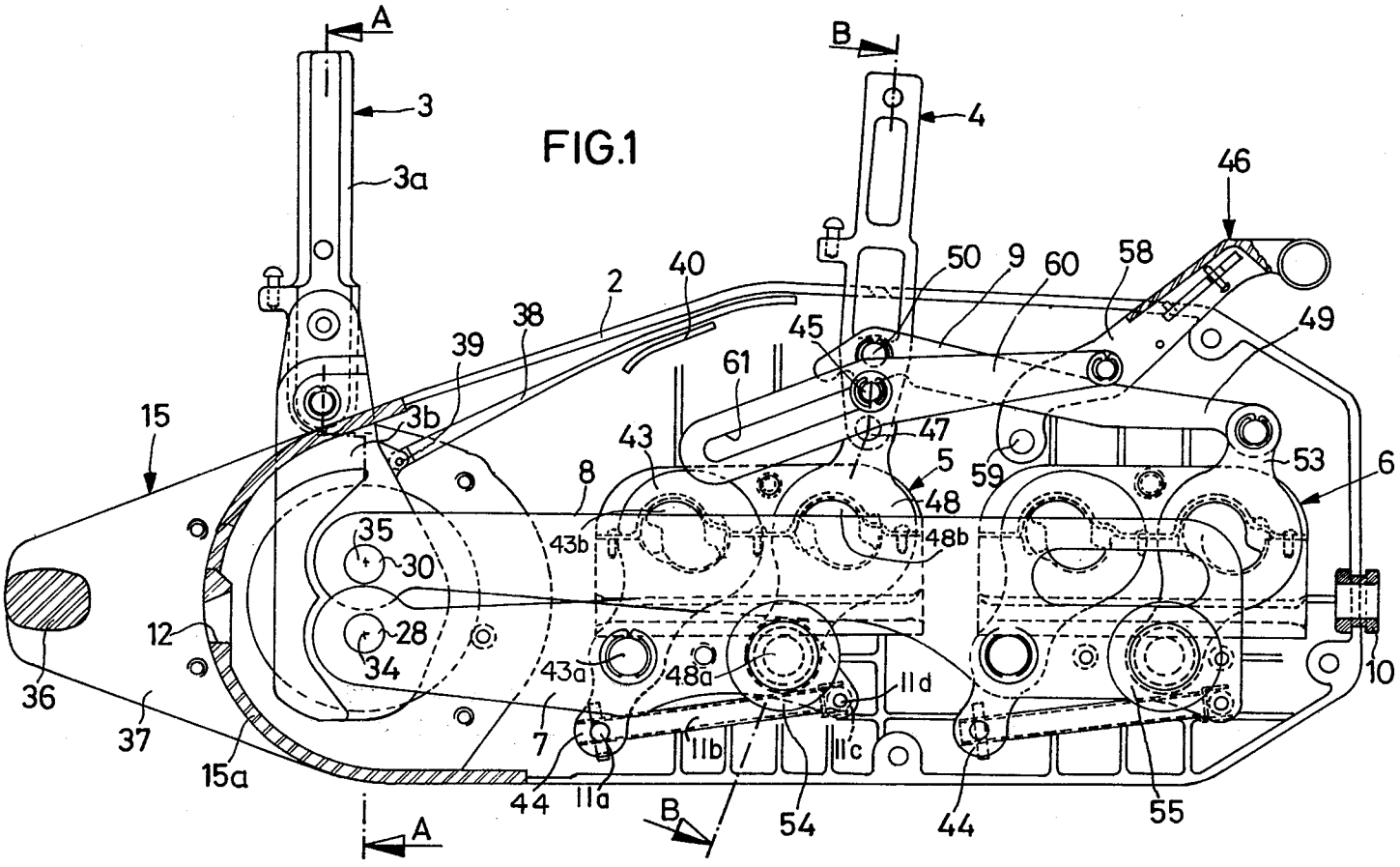

The present invention relates to a cable hauling and hoisting apparatus comprising self-clamping jaws that are movable in opposite directions and operated so that one of the jaws alternately clamps and takes along the cable while the other jaw freely moves along the cable.

This type of hauling apparatus are already known for example from French Pat. No. 914,400, to which U.S. Pat. No. 2,585,101 corresponds, and is used to lift heavy loads (for example, with a direct traction, 1–3 tons). They are operated by a lever which oscillates in such a way that cam levers disposed in the self-clamping jaws can in turn be operated in the above described manner by means of the mechanism comprising a double handle and rods which connect this double handle with the self-clamping jaws.

All these apparatus are modifications of one of the possible embodiments of the same kinetic principle, the above mentioned principle of the self-clamping jaws, which in practice has been considered as being very disadvantageous. Accordingly all of the embodiments show, despite the excellent principle they depend on, the same disadvantage, which in connection with larger designs (with a capacity of for example 2–3 tons) becomes very important: their specific performance is very small. In fact on the one hand the weight of the more powerful designs is so important that it can only be carried out with difficulty and, on the other hand, which is even worse, the power applied to the actuating lever is so important in comparison with the one required by other hauling and hoisting apparatus (such as pulley blocks actuated by lever, lifting gears actuated by handle etc.), that the operation quickly becomes very laborious even for a sturdy worker.

If the specific performance of this apparatus as well as that of one of the usual lever actuated hauling apparatus (with handle) is defined by:

$$\pi = \frac{l}{P} \cdot \frac{C}{F} \cdot \delta$$

wherein $P$ is the weight of the apparatus, $C$ is the effective traction force of the apparatus;

$F$ is the force to be applied on the actuating lever to hoist a weight corresponding to the effective force C;

$$\delta = \frac{l_{id}}{L_{id}}$$

is the ratio of total gearing down of the mechanism, which is equivalent to the ratio of an ideal lever, the power arms, respectively the resistance of which are given by the products $L_{id} = L_1 \cdot L_2 \cdot \ldots$ and $l_{id} = l_1 \cdot l_2 \cdot \ldots$ of the lever arms $L_x \cdot l_x$ of the successive gearing down actions used in the apparatus, wherein the first one $l_m/L_m$ corresponds to the actuating lever and the last one $l_s/L_s$ to the clamping lever of the self-clamping jaws, or by expressing $L_m, l_s$ in function of the distance covered by the power arms of the actuating lever and effectively by the resistance arm of the clamping lever as well as by the respective angle of oscillation $x_m, x_s$ and by pointing out these expressions:

$$\pi = \frac{l}{P} \; \frac{C}{F} \; \frac{s_s/2 \sin(\alpha_s/2)}{S_m/2 \sin(\alpha_m/2)} \cdot \Delta\delta$$

wherein $\Delta\delta$ represents the gearing down ratio (of a lower rate) complementary to $l_s/L_s$ in such a way that finally for $$\alpha_m = \alpha_s :$$

$$\pi = \frac{l}{P} \; \frac{C}{F} \; \frac{s_s}{S_m} \cdot \Delta\delta$$

it will be noted that the value of the specific performance is on the one hand directly proportional to the effective force of the apparatus and to the movement of the clamping levers (and of the cable) for half an oscillation in one or the other direction of the actuating lever, and on the other hand is inversely proportional to the weight of the apparatus, to the actuating force (at full load) and to the longitudinal movement of the grip of the actuating lever.

By applying this expression to the commonly used hoisting apparatus and to hauling and hoisting apparatus comprising self-clamping jaws it can be seen that effectively with regard to the last mentioned apparatus, the value of $\pi$ is much lower than the one corresponding to a pulley block actuated by levers or to a lifting gear actuated by handle.

It has been recognized however that the direct or indirect reason for the low specific performance of these apparatus depending from the disadvantageous embodiment of the kinetic principle serving as basic principle, is only one: the use of the double handle by means of which the actuating lever operates the apparatus in forward operation. This part, the function of which consists in providing, in cooperation with the cam levers of the clamping blocks, a gearing down which permits to hoist extremely important loads in comparison with the power of a man, substantially reduces the value of $\pi$ due to the fact that it makes, directly or indirectly, each of the main ratios of the same dimension $l/P$, $C/F$, $l_s/L_m$ of the expression very high.

A. The expression P of the first ratio of same dimension is in fact relatively high, directly because of the important rate of the double handle itself which, due to its function, has to be extremely resistant and heavy, and has to comprise a shaft which has to be similarly resistant and heavy, and indirectly because the ends of the handle shaft are disposed in the housing which has to have resistance and rigidity characteristics permitting in a convenient way the transmission of the traction of the cable at the retention point. It is difficult to realize this condition because of the high load and of the housing dimensions, and because it further comprises two parts secured together by means of screws, and provides in any case that the apparatus becomes heavier, and accordingly inconsistant with the required characteristics of handiness.

B. The expression 'F' of the second ratio of the same dimension is very high in comparison with the expression 'C' with regard to the plurality of facts which are all, directly or indirectly, imputable to the use of the double handle provided in this disadvantageous embodiment and all contributing to condition an insufficient shape resistance of the parts which form the apparatus, which condition provides with regard to each of these facts, a considerable increase of the resistance forces of friction (and implicitly of the value 'F').

a. One, and the most important, of these factors depending directly on the presence of the double handle, is represented by the fact that the housing in which the bearings of the double handle are disposed is constituted of two symmetrical members, secured together by screws, because this involves, 1. the fact that is is impossible to realize in practice an exact alignment of these bearings and, therefore 2. the inconceivability of a coincidence of the axis of the shaft of the double handle with the axis of the bearings which at first sight are not coinciding with each other.

The friction forces created between the actuating shafts and their bearings are in this way disposed in a non-uniform way and concentrated to restricted areas of the contact faces (which, besides, are submitted to a quick wear). The result of these forces provides a very considerable part of the passive resistances and provides not only in a determinative manner that the operation of this apparatus is uselessly fatiguing, but that its performance is further restricted.

b. A second factor, depending on the first factor and also related directly to the existance of the double handle, on which depends the insufficient shape resistance of the apparatus of this kind, is constituted by the fact the actuating lever provided for effecting the forward movement, which is exactly the one which provides in the mechanism of the force transmission as well as in the housing the highest stresses, is cantilevered on one side of the apparatus. This position of the actuating lever only provides an asymmetrical distribution of the stresses in the whole apparatus and accordingly contributes above all to the disalignment of the bearings of the shaft of the actuating levers, whereby one of the bearings is provided in one housing half and the other one in the other housing half. Accordingly there is an important increase of the friction forces compared to that of a central position of the actuating lever.

c. A third factor depending on the first and on the second factor and also provided by the disadvantageous embodiment of the basic kinetic principle and also causing the insufficient shape resistance of these apparatus and the high friction forces, is provided by the fact that due to the asymmetrical feature of the deformation of the bearings of the operating shaft and of the shaft itself, lack the parallelism between the axis of the bearings of the shaft of the double handle, which should coincide mutually and with the axis of the shaft of the actuating lever, and the pivotal axis of the connecting rods with the double handle on the one hand and with the self-clamping jaws on the other hand. Considerable friction forces are thereby created also between the connecting rods and their pivots.

d. A fourth factor to which can be attributed in part the reason of the insufficient shape resistance of the apparatus and of the resulting important friction forces is represented by the fact that the pivot axis of the connecting rods with the double handle as well as the pivot axis of the same connecting rods with the self-clamping jaws are cantilevered. As the efforts provided in the pivots of the connecting rods in the connecting rods themselves and in the connected members (the double handle and the bearing brackets of the self-clamping jaws) are distributed in a non-uniform manner, the friction forces developed on the contact faces of the pivots are also distributed in a non-uniform manner and concentrated on restricted areas of these faces (which in this way are also subjected to a quick wear).

e. The insufficient shape resistance of this known type of apparatus, which is due to the various above cited factors, provides in each case, as it has been noted, an increase of the friction forces in the pivots and implicitly of the necessary force to operate the actuating lever, but it can further be noted that this increase is made more important because of the fact that for the pivots of the double handle with the housing and the connecting rods as well as for the pivots of these same connecting rods with the clamping jaws sliding bearings are used for obstruction reasons. In this case the value of the friction forces, particularly if the bearings cannot be regularly lubricated, is a multiple of the value corresponding to the use of well designed bearings.

C. The value of the third ratio of the same dimensions $s_s/S_m$, which corresponds to the specific movement (with regard to the covered distance parallel to the cable by the grip of the lever), is relatively low, and this circumstance is considered as very unfavorable, first because the average speed (bearing in mind the fact that the operator has to make frequent rest periods to the operation) becomes too low and on the other hand the efficiency would be excessively diminished due to the fact that one part of each oscillation of the lever is used in this type of apparatus for passing the clamping pressure of the cable from one to the other self-clamping jaw in such a way that the jaw which clamps the cable does not open before the other one is not exerting its full clamping action on the cable.

Accordingly, the reduced value of the term $s_s/S_m$ is cleared up with the use of the double handle because it does not allow to improve the gearing down ratio by the reduction of the resistant arm of the actuating lever, $l_m$. A greater movement of the cable could in fact be obtained by the same optimal value of the oscillation angle only by stretching the arm of the resistance of the clamping levers, which consequently would increase the moment (resistance) of the action of the load. In order to keep the effective force as well as the actuating force unchanged, the moment of the actuating force should have to be increased by stretching the actuating lever in a corresponding (proportional) manner which could hardly be obtained because of the average somatical characteristics of the operator or by diminishing the moment of the action of the load which is transmitted by means of the mechanism to the resistance arm $l_m$ of the actuating lever by shortening the arm $l_m$. On the other hand such a reduction could not be obtained with the present embodiment because $$l_m = \tfrac{1}{2} \cdot l_b - \tfrac{1}{2} (\phi_{am} + l_b)$$

wherein $l_b$, which corresponds to the distance of the pivot axes on the shaft of the handle, is at least equal to the addition of the diameter of the shaft of the handle $\phi_{am}$ and of the width of a connecting rod $L_b$.

The object of the invention is to improve the specific performance of the commonly used hauling apparatus comprising self-clamping jaws by improving the transport possibilities and making it handier by diminishing the necessary force required to actuate the apparatus and/or by increasing the unitary movement of the cable.

The object of the invention is obtained in that the apparatus is provided with a force transmission device based on the same kinetic principle as the known apparatus of this kind, but constructed, considering the whole unit as well as the various parts of which it is composed, in a more rational manner, and that this construction is changed in a sense to provide an improvement of the specific performance by modifying the value of each of the ratios of the main values of same dimension contained in the formula, i.e., $l/P$, $C/F$, $l_s/L_m$, by the product of which it is given.

On the other hand the device according to the invention increases, if necessary, the performance of the new apparatus over the nominal performance for using an actuating force comprised between the actuating force corresponding to the nominal performance of the new apparatus and that of the older apparatus.

In the apparatus according to the invention the following characteristics have to be noted:

1. the actuating lever for the forward movement is rotatably fixed at its upper end in a single block head which is separated from the housing enclosing the mechanism and which has a design permitting to bore into its lateral parts the bearing seats (preferably ball bearings) of the oscillation bearing pins of the actuating lever in a single operation. Furthermore this head comprises at its forward end a transverse area having the shape of a retention member by means of which the apparatus can be secured at a fixed point, thereby providing the automatic alignment and permitting also to carry it;

2. the connecting rods are pivoting directly on the lower end of the actuating lever inside the bearing pin of this lever, and in such a manner that the connecting rods corresponding to the two self-clamping jaws are mutually offset parallel to the axis of the bearing pins so that it is possible to approach their forward pivots independently of the width of the connecting rods;

3. the articulation of each connecting rod with the actuating lever is provided by two bearings (preferably ball bearings) disposed on each side of the connecting rod);

4. the lower portion of the lever comprises a vertical oblong opening, whereby the front pivots of the connecting rods are disposed at a certain axial distance from the two sides of this opening, so that the cable can pass freely;

5. the housing comprises two thin casing halves which are provided with ribs, and merely protects the mechanism from foreign particles;

6. due to a practical choice of the dimensions of the different component parts which form the force transmission device, it has been possible to amend the working rate of each member and of the assembly of the members forming these component parts, i.e. to utilize to a maximum the resistance of the materials to the different efforts. Thus it has been possible to use exclusively light weight alloys mainly for the head, for the actuating levers and for the housing.

It can be shown that an apparatus having the above mentioned characteristics eliminates the cited disadvantages and, considering the objects of the invention, due to the new embodiment of the known kinetic principle, an important reduction of the weight of the apparatus is obtained and a complete reduction of the friction resistances and similarly of the actuating force, as well as a more important advancement of the cable. In fact:

A'. The heavy double handle of the forward movement with its sturdy shaft is no longer used and the weight of the apparatus is reduced by this weight.

Due to the fact that the oscillation bearing pins of the actuating lever are disposed in the bearings of the head, the efforts are concentrated on the head, and the housing which is no longer providing the transmission of the forces of the cable at the fixed point, can have a light weight construction: due to this fact the weight is also decreased in a most important way.

Another very interesting reduction of the weight can be seen mainly with reference to certain apparatus which in order to develop a large capacity, use a double gearing down action, by transmitting the force exerted by the resistance arm of the actuating lever through a power arm disposed on the double handle. The new apparatus is no longer heavy because of the reinforcement which had been necessarily provided for the lower portion (resistance arm) of the actuating lever and for the head of the double handle (which becomes the power arm) and further is not made heavier by the connecting rods connecting the actuating shaft and the double handle.

A heavy retention hook is no longer used in the apparatus. It has been substituted only by a retention member of small dimension and small weight.

The apparatus is no longer provided with a transport grip: the retention member has also this function.

B'. Due to the fact that the double handle is no longer used and that the efforts in the transmission system have been concentrated in the single block head, all the factors which determine the insufficient shape resistance of the apparatus as well as the power losses which resulted because of the intense friction forces developed on the contact faces of the different articulations disappear. Particularly:

a'. The fact that the bores provided for the disposition of the bearing pins of the actuating lever can be made in the same part, the single block head, and this in a single operation and by using for these bearing pins large size roller bearings whose manufacturing tolerances for mechanical parts are extremely small guarantee;

1. An exact reciprocal alignment of the axes of the bearings on the one hand, and of the axis of the ball bearings on the other hand;

2. An exact coincidence of the common axis of the bearing pins of the actuating lever and of the common axis of the ball bearings;

3. The uniformity of the distribution of the friction forces on the contact surfaces and a substantial reduction of the pressure of these forces (and of the resulting important wear) due to their concentration in the restricted areas.

b. The constancy of this initial exact alignment of the bearings of the bearing pins of the actuating lever and of the ball bearings, and of this initial exact coincidence of the axis of the bearings and of the common axis of the bearing pins, is ensured by the compactness and by the rigidity of the single piece head as well as by the fact that in this new embodiment of the basic kinetic principle, all the outside forces acting on the head, i.e. the weight of the load, the force applied to the actuating lever and the reaction of the fixed point, are and remain comprised in the same plane, which coincides with the symmetrical plane of the apparatus, whereas all the stresses produced in the parts of the transmission mechanism of the forces are contained in the plane which, two by two, are symmetrical with respect to the plane of the outside forces;

c./d. By using articulations on two bearings for the forward pivots of the connecting rods connecting the actuating lever and the self-clamping jaws, the other factors responsible for the insufficient shape resistance of the known apparatus are eliminated: these pivots no longer undergo respectively no longer provide a dissymmetry of the forces interacting on the housing (which thus is no longer subjected to solications due to its function of transmitting the forces), on the oscillation bearings of the actuating lever, on the front and back articulations of the connecting rods and on the brackets of the self-clamping jaws. The interactions between the contact surfaces of all the articulations of the system, and further the friction forces thus generated, also in view of the use of ball bearings which has become possible in the new embodiment of the main kinetic principle, are now reduced to a minimum, completely symmetrical with regard to the median plane of the apparatus and distributed according to a uniform variation on the contact surfaces:

3. the use of ball bearings in order to dispose the bearing pins of the shaft of the actuating lever and the pivots (two bearings per pivot) by means of which the connecting rods are articulated on the actuating lever reduces finally the respective friction forces to a small fraction of those corresponding to slide bearings, the use of which had been imposed, in the disadvantageous actual embodiment of hauling and hoisting apparatus comprising self-clamping jaws due to obstruction.

C'. It has been seen that it is not possible to increase at will the power arm of the actuating lever. But on the other hand in pursuance of the new embodiment of the main kinetic principle it is possible to shorten the resistance arm, because the distance between the articulation point of the actuating lever and the articulation of each rod connecting this lever to a self-clamping jaw is no longer limited as in the older embodiment, either by the diameter of the shaft of the double handle which is no longer used, or by the width of one of the connecting rods, since these are contained, as it has been noted, in the vertical planes which are separated and parallel, and that consequently the trajectories of their points do not interfere mutually during the entire movement. Thus it is possible to shorten the resistance arm to an optimal value depending mainly on the cord of the arc executed by the grip of the actuating lever on the one hand and on the cord of the arc executed by the articulation axis of each connecting rod with the actuating lever on the other hand.

Figure 2:
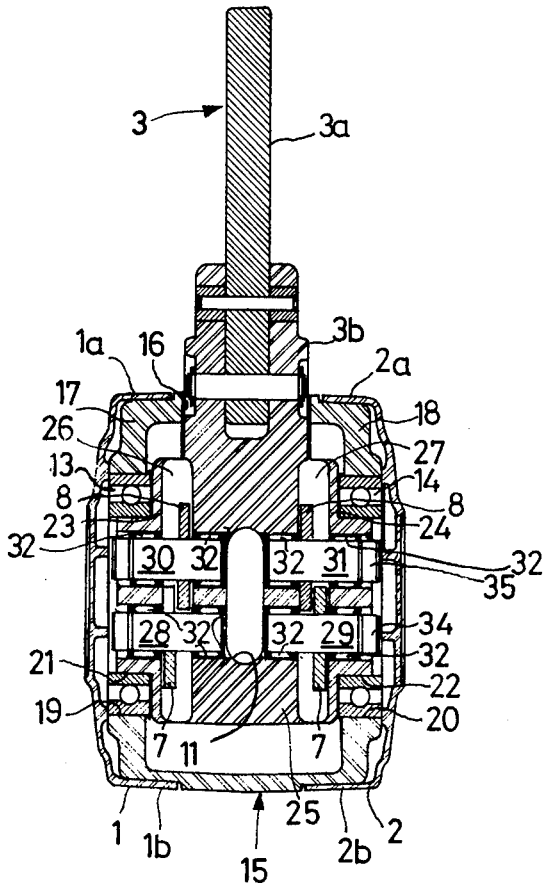
Figure 3:
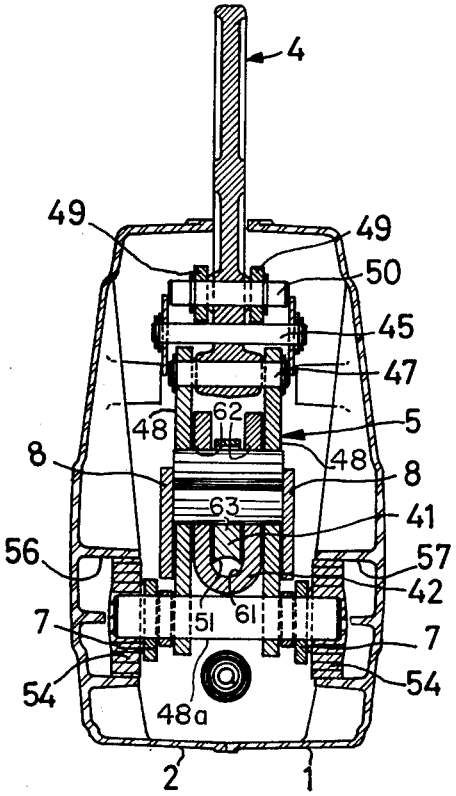

An embodiment of the invention will now be described with reference to the accompanying drawings wherein, FIG. 1 shows a cable hauling apparatus according to the invention, one half of the housing not being shown in order to more clearly represent the interior of the apparatus, FIG. 2 is a section along line A—A of FIG. 1, FIG. 3 is a section along line B—B of FIG. 1.

The cable hauling apparatus shown in the drawings comprises a one piece head 15, an actuating lever 3 for forward operation pivotably mounted at the head 15, an actuating lever 4 for rearward operation, two self-clamping jaws 5, 6 connected to the actuating lever 3 by means of connecting rods 7, 8 and to the actuating lever 4 directly and respectively by means of connecting rods 49, an unlocking device 58 to 61 and a housing 1, 2.

The head 15 is a compact and rigid one piece member separated from the housing 1, 2 and located at the forward end of the apparatus. The lateral portions 17, 18 of the head 15 have bores 19, 20 therein, wherein ball bearings 13, 14 are located which serve for the pivotable mounting of the actuating lever 3, and are connected together at their underside and at the forward side by a cylindrical surface 15*a* having a slot 16 which permits the oscillating movement of the actuating lever 3. In addition the cylindrical surface 15*a* has a hole 12 elongated in the vertical direction through which the cable may leave the apparatus (not shown), the other end of the device having a corresponding cable hole 10 therein. The lateral portions 17, 18 are in addition connected together at their forward end 37 by a retention member 36 constructed to permit self-alignment of the apparatus and serving at the same time as a grip to carry the apparatus. The actuating lever 3 for forward operation has an upper portion 3*a*, on which an extension of desired length may be fixed, and a lower portion 3*b*, which has dimensions such that the oscillating pins or trunnions 21, 22 thereon may be integral with this lever. In fact, a disc or hood 23, 24 is disposed on each lateral side of the lower portion 3*b*, these two discs being located at a given distance, measured in a parallel direction with respect to the axis of oscillation, from the central portion 25 of the lever 3 and being integral with this central portion at the forward sides of the lever.

The hoods 23, 24 are each extended in the axial direction by the cylindrical trunions 21, 22 carried thereon, and the trunnions 21, 22 are respectively received in bearings 13, 14 carried in openings in the opposed lateral walls of the head 15.

Between each disc or hood 23, 24 and the central body 25 of the actuating lever 3 a cavity 26, 27 is provided which is open toward the rear portion of the lever, and two connecting rods 7, 8 extend into each cavity. These rods are pivotably connected at one end to the actuating lever 3 by pivot pins 28 to 31, and at their other end to the two self-clamping jaws 5, 6, respectively. The forward pivot pins 28 to 31 are preferably rigidly fixed to the connecting rods 7, 8.

The pivot pins 28 to 31 may rotate in an equal number of pairs of bearings 32, preferably needle bearings, located on opposite sides of the rods 7, 8 and provided in the central body 25 of the actuating lever 3 and in the hoods 23, 24. The forward pivot pin which are associated with the same self clamping jaw, (28, 29; 30, 31) and therefore also the respective pairs of bearings 32, have a common axis, and the parallel axes 34, 35 of the pivot pins, respectively associated with the self-clamping blocks 5, 6 are located one above and the other below the common bearing axis of the trunnions 21, 22, and the plane defined by the axes 34, 35 of these pivot pins passes through this common axis of the trunnions.

The two rods 7, 8 which are not associated with the same self clamping jaws, which extend into each of the two cavities 26, 27 arranged between the hoods 23, 24 of the lever and the central body of the lever are not located in a common vertical plane, but in two parallel vertical planes spaced by an axial distance so that they do not impede one another in their movement.

The two pairs, 28, 30; 29, 31 of the forward pivot pins of the rods 7, 8 located in the above mentioned cavities are spaced one from the other by a given axial distance such that they determine an opening 11 having an increased length in the vertical direction to permit the free passage of the cable.

Each self-tightening clamp 5, 6 comprises (as shown in FIG. 1 and, e.g. for clamp 5, in FIG. 3) a flat upper jaw 41 and a U-shaped lower jaw 42, in side arms of which extend on either side of the flat jaw. The lower edge or surface of jaw 41 has an arcuate concave contour 51 of a radius corresponding to the radius of the cable to be used with the device, and the inner bottom of the U-shaped jaw 42 has a corresponding half-circular contour 61, whereby the contours 51 and 61 will clamp the cable on the major part of its periphery when the jaws are in their cable gripping position.

Both jaws are movable between tightening levers pivoted on the driving rods 7. These levers consist of two pairs of parallel levers 43, 48; levers 43 and levers 48 have the same contour and register with each other on either side of the set of jaws 41, 42. The levers 43 are pivoted about a common pin **43*a* rigid with the driving rod 7; similarly, the other pair of levers 48 disposed on either side of the set of jaws 41, 42 are pivoted on a common pin 48*a* parallel to the other pin 43*a* and also rigid with the driving rod 7**.

Both tightening levers 43 are rigid with a transverse cam **43*b* extending through adequate apertures formed in both jaws, the other pair of levers 48 being also rigid with a transverse cam 48*b* extending through other apertures formed in both jaws. These cams consist of bar sections of the same cross-sectional contour consisting of two equal half-circles having their centers shifted on their common diameter and being disposed on either side of this diameter, this contour being completed by two straight diametral portions of said common diameter which lie outside said half-circles. Both tightening levers 43 have extensions 44, beyond the pivot pin 43*a*, and these extensions carry between each other a cross member 11*a* pivoting freely in holes formed in said extensions. This cross member acts as an abutment to one end of a compression coil spring 11*b* surrounding a guide rod having one end adapted to slide through a central hole formed in said cross member 11*a*, and its other U-shaped end 11*c* is adapted to bear against a pin 11*d* rigid with the driving rod 7. Said spring 11*b*, by reacting against the cross member 11*a* and pin 11*c*, constantly urges the levers 43 for rotation with respect to the driving rod in the direction to close the jaws, as will be explained presently. This pivotal movement of levers 43 is attended by a corresponding movement of levers 48 which is transmitted through the jaws. The tightening levers 43 and 48, and jaws 41 and 42, constitute together a parallel linkage so that levers 43 and 48 and therefore jaws 41 and 42** remain constantly parallel to each other.

The upper flat jaw 41 is formed with identical transverse apertures 62 for both cams, and each aperture 62 has a part-cylindrical lower arcuate portion of a radius equal to that of the aforesaid semi-circular portions of cams **43*b*, 48*b*. This portion is engageable by the lower half-cylinder of the contour of the corresponding cam. The only function of the other portion of aperture 62** is to permit the free movement of the upper half-cylinder of said cam. The position illustrated in FIGS. 1 and 3 correspond to the clamping position.

The lower U-shaped jaw 42 comprises identical transverse apertures 63 for the two cams and if desired these apertures may be the same as the apertures 62 of jaw 41, but they are disposed symmetrically with respect to a point located in the middle of the center line of the cylinders forming the cross-sectional contour of cams **43*b*, 48*b*. Thus, each aperture 63** has a part-cylindrical upper portion engageable by one half-cylindrical cam portion, and the remaining portion of this aperture permits the free movement of the other half-cylindrical cam portion.

It will be noted that the upper jaw 41 can be brought into a release position away from the lower jaw and from the cable by adequately shaping the contour of each aperture 62 of the upper jaw above its part-cylindrical portion in order to constitute for each cam an abutment engageable by the straight portion of its contour in the release position. This arrangement is advantageous in that it permits the free passage of the cable in its inoperative or release position. In practice, the jaw 41 may consist of two superposed elements rigidly assembled to each other, the said abutments being carried by the upper element. The bar sections constituting the cams **43*b* and 48*b* are mounted in the corresponding apertures of levers 43, 48**, which will thus engage the bar sections along the straight portions thereof, so that the levers are rigid with the cams.

The backward control lever 4, which through connecting rods 49 operates directly the levers 48, 53, actuating the clamps 5, 6, is pivotally mounted between the pins 47, 50 on a floating pin 45 which can be shifted by means of a disengaging device 46 adapted to be held still when the effect of clutch release, i.e., the opening of both clamps, is desired.

The housing is formed as already indicated above by two housing halves 1, 2 which are very thin and which are fabricated from a light weight alloy. The housing halves are provided with stiffening ribs. These housing halves are provided with upper edges **1*a*, 2*a* and lower edges 1*b*, 2*b* on which the halves may be secured by means of bolts and firmly maintained at their forward ends on the head 15**, and at their remaining portion, i.e. the central and rearward portions of the apparatus, in engagement with one another, where they are made larger for this purpose.

The two housing halves, which are joined along their upper, rearward and lower sides, have a sufficient shape resistance to protect the mechanism located on the inside and the housing halves prevent at the same time the entrance of foreign particles about the complete circumference with the exception of the portion where the slot 16, permitting the oscillation movement of the lever for rearward operation 4, is provided.

A sufficient seal is also assured at this place by means of an arm 38, preferably made from flexible plastic material, which is pivotably mounted on an axis 39 integral with the actuating lever for forward operation 3 and which is retained in position by means of two projections 40 provided on the housing halves.

The clamp action and thus the apparatus operation will be readily understood from the above description, and said U.S. Pat. No. 2,585,101, and may be summarized as follows: As the compression spring **11*b* tends to clamp the jaws on the cable, if the right-hand end of this cable (FIG. 1) is attached to a load producing a pull towards the right, the cable will tend to pivot both pairs of levers 43, 48 in the clockwise direction about the pivot pins 43*a*, 48*a* from the position illustrated in FIG. 1. As a result, the upper part of the cam contour will tend to rise with respect to the lower part of this contour, and therefore to raise the lower jaw 42 with respect to the upper jaw 41**. This action corresponds to the self-gripping effect.

If on the other hand no pull is exerted by the cable (for example because it is engaged by another clamp), and if some control means acts upon the levers against the resistance of the compression spring 11*b* to pivot said levers in the counterclockwise direction (FIG. 1), the grip is released and the cable can slide between the jaws.

When the forward drive control lever 3 is reciprocated, the two driving rods 7, 8, and so the two clamps 5, 6, are moved in opposite directions. When the clamps are moved towards each other the reaction of connecting rod 49 tends to pivot the levers of the rear clamp 6 in the clockwise direction corresponding to the gripping action of the clamp, and to pivot the levers of the front clamp 5 in the release direction. Under these conditions, if the cable threaded through the apparatus has a load attached to its right-hand end, this load will be pulled by the clamp 6 during the operation just described. When reversing the movement to move the clamps 5, 6 away from each other, the clamping and release positions are reversed, and the load will be again pulled in the same direction, but this time by the other clamp 5.

If instead of actuating the lever 3 the operator actuates the lever 4, it is clear that similar reversals of the clamping and releasing actions will take place, but this time it is the clamp moving to the right that is tightened, so that this maneuver will permit the backward movement (towards the right as viewed in FIG. 1) of the load attached to the cable. Finally, if the releasing member 56 is turned to the left on pivot 59, the two clamps are opened simultaneously by the intermediary of connecting rods 60, 9, to permit introducing the cable into the apparatus or to draw it out, or else to let is freely pass through.

The driving rods 7 and 8 consist of lateral plates between which the gripping levers and the jaws are mounted, and on the pivot pins 48*a* of levers 48 (FIGS. 1 and 3) rollers 54, 55 are provided outside the driving rods 7, 8, these rollers traveling in longitudinal grooves 56, 57 formed in the housing 1, 2 of the apparatus, thus ensuring a very smooth operation of the apparatus and a perfect alignment of the jaws therein.

The preceding description refers to an embodiment of the invention, but is not a limitation for other practical embodiments constructed according to the basic kinetic principle. This particular embodiment does therefore not prevent that one may obtain in a similar way the same improvement of the specific efficiency of this apparatus by modifying one or the other element of the described construction within the scope of the following claims.

What is claimed is:

1. Cable hauling apparatus, comprising:

housing means;

first and second clamping jaw means mounted within said housing in spaced, aligned relationship, and adapted when in an open condition to receive a cable therethrough;

a first pair of spaced, parallel connecting rods connected at the rear ends thereof to said first clamping jaw means;

a second pair of spaced, parallel connecting rods connected at the rear ends thereof to said second clamping jaw means;

backward control lever means connected with said first and second clamping jaw means, and arranged to extend from said housing means;

a head member mounted at the forward end of said housing means, and separate therefrom, said head member including a pair of lateral portions having aligned bores therethrough arranged concentrically about an axis extending transversely of said first and second jaw means, said lateral portions being connected at the forward end thereof, and being open at their rearward end facing said first and second jaw means;

a forward control lever, including a lower body portion receivable between said lateral portions of said head member, said lower body portion having axially aligned trunnions on the opposite sides thereof receivable within said aligned bores in said head member, whereby said forward control lever is mounted for pivotal movement about said transverse axis, said forward control lever further including a handle portion arranged to extend outwardly from said head member and said housing means; and first and second, transversely extending pivot pin means carried by said lower body portion of said forward control lever, said first and said second pivot pins means being mounted within the outer diameter of said aligned trunnions on opposite sides of and spaced outwardly from said transverse pivot axis;

the forward ends of said first and said second pair of said parallel connecting rods being connected with said first and said second pivot pin means, respectively.

2. Cable hauling apparatus as recited in claim 1, wherein said first and said second transverse pivot pin means lie in the same plane as said transverse pivot axis, and are symmetrically mounted with respect thereto.

3. Cable hauling apparatus as recited in claim 1, wherein said lower body portion of said forward control lever has hoods on the opposite sides thereof, the forward ends of said hoods being connected with said lower body portion on the forward side thereof, and the rearward portions of said hoods being spaced from said lower body portion to form rearwardly facing cavities, said aligned trunnions being carried by said hoods, said first and second pivot pin means being mounted to extend across said rearwardly facing cavities, and said forward ends of said first and said second connecting rods being received said rearwardly facing cavities and being mounted on the portions of said first and second pivot pin means extending said cavities.

4. Cable hauling apparatus as recited in claim 3, wherein said first and said second pivot pin means are fixed to their respective first and second connecting rods and the opposite ends thereof are received within bearings mounted within transverse bores provided in said hoods and said lower body portion, and wherein said trunnions are received within bearings mounted in said aligned bores in said head member.

5. Cable hauling apparatus as recited in claim 3, wherein said forward ends of said first and said second connecting rods are flat and planar in configuration, and wherein said rearwardly facing cavities have a width at least equal to the combined thickness of the forward ends of said first and second connecting rods received therein.

6. A cable hauling apparatus as recited in claim 3, wherein the rearward end of said housing means and said head member are provided with an opening to receive a cable, and wherein said lower body portion of said forward control lever has an opening therethrough to receive said cable, said rearwardly facing cavities being disposed on the opposite sides of said cable opening.

7. A cable hauling apparatus as recited in claim 6, wherein said head member has a transverse holding element mounted thereon, outwardly of said cable opening.

* * * * *